US009562544B2

(12) United States Patent
Clausen et al.

(10) Patent No.: US 9,562,544 B2
(45) Date of Patent: Feb. 7, 2017

(54) HYDRAULIC SYSTEM

(71) Applicant: miniBOOSTER HYDRAULICS A/S, Soenderborg (DK)

(72) Inventors: Joergen Mads Clausen, Soenderborg (DK); Christen Espersen, Augustenborg (DK); Leif Hansen, Soenderborg (DK); Brian Petersen, Soenderborg (DK); Joergen P. Todsen, Nordborg (DK); Poul Ennemark, Soenderborg (DK); Knud Meldgaard Jensen, Soenderborg (DK); Tom Tychsen, Graasten (DK)

(73) Assignee: miniBOOSTER HYDRAULICS A/S, Sonderborg (DK)

( * ) Notice: Subject to any disclaimer, the term of this patent is extended or adjusted under 35 U.S.C. 154(b) by 284 days.

(21) Appl. No.: 14/462,854

(22) Filed: Aug. 19, 2014

(65) Prior Publication Data

US 2015/0052888 A1 Feb. 26, 2015

(30) Foreign Application Priority Data

Aug. 22, 2013 (EP) ..... 13181391

(51) Int. Cl.
*F15B 3/00* (2006.01)
*F15B 11/032* (2006.01)

(52) U.S. Cl.
CPC ..... *F15B 3/00* (2013.01); *F15B 11/032* (2013.01); *F15B 2211/214* (2013.01);
(Continued)

(58) Field of Classification Search
CPC ..... F15B 11/032; F15B 2211/214; F15B 2211/3051; F15B 2211/30515; F15B 2211/50527;F15B 2211/7053; F15B 2211/7058
See application file for complete search history.

(56) References Cited

U.S. PATENT DOCUMENTS 7,686,596 B2 * 3/2010 Clausen ..... F15B 3/00 417/415
2012/0204553 A1 * 8/2012 Junttila ..... F15B 11/0325 60/563

(Continued)

FOREIGN PATENT DOCUMENTS

EP 2327884 A1 6/2011
FI WO 2011048271 A1 * 4/2011 ..... F15B 11/0325

(Continued)

OTHER PUBLICATIONS

European Search Report Serial No. EP13181391 dated Jan. 10, 2014.

*Primary Examiner* — Thomas E Lazo
(74) *Attorney, Agent, or Firm* — McCormick, Paulding & Huber LLP

(57) ABSTRACT

A hydraulic system (1) is provided comprising a supply port arrangement (P, T), a working port arrangement (A, B), and a booster section (7), said supply port arrangement having at least a supply port (P), said booster section (7) being arranged between said supply port arrangement (P, T) and said working port arrangement (A, B). The operational possibilities of such a hydraulic system should be extended. To this end said working port arrangement comprises at least two working ports (A, B), flow direction changing means (9) are provided changing a flow direction through said working port arrangement and inactivating means (16) are provided inactivating or activating said booster section (7) for each flow direction.

20 Claims, 3 Drawing Sheets

(52) U.S. Cl.
CPC ..... *F15B 2211/3051* (2013.01); *F15B 2211/30515* (2013.01); *F15B 2211/50527* (2013.01); *F15B 2211/7053* (2013.01); *F15B 2211/7058* (2013.01)

(56) References Cited

U.S. PATENT DOCUMENTS

| | | | | |
|---|---|---|---|---|
| 2012/0304633 | A1* | 12/2012 | Rozzi De Hieronymis | F15B 15/204 60/393 |
| 2013/0068090 | A1* | 3/2013 | Luyendijk | F15B 11/022 91/166 |

FOREIGN PATENT DOCUMENTS

| | | | |
|---|---|---|---|
| WO | 9601953 | A1 | 1/1996 |
| WO | 2011048271 | A1 | 4/2011 |
| WO | 2011104662 | A1 | 9/2011 |

* cited by examiner

HYDRAULIC SYSTEM

CROSS REFERENCE TO RELATED APPLICATION

Applicant hereby claims foreign priority benefits under U.S.C. §119 from European Patent Application No. EP13181391.7 filed on Aug. 22, 2013, the contents of which are incorporated by reference herein.

TECHNICAL FIELD

The invention relates to a hydraulic system comprising a supply port arrangement, a working port arrangement and a booster section, said supply port arrangement having at least a supply port, said booster section being arranged between said supply port arrangement and said working port arrangement.

BACKGROUND

Such a system is known, for example, from U.S. Pat. No. 7,686,596 B2.

The pressure source, e.g. a hydraulic pump, supplies hydraulic fluid under a predetermined pressure. A hydraulic consumer connected to the output can be operated by means of this predetermined hydraulic pressure.

In some applications the pressure supplied by the pressure source is not sufficient to operate the hydraulic consumer or the load connected to the output, so that a pressure booster is used to permanently amplify the pressure supplied by the pressure source. The pressure booster is a pressure intensifier increasing the pressure supplied to the output. An alternative to a pressure booster is a flow booster. A flow booster increases the fluid amount that is transported in the flow direction.

SUMMARY

The object underlying the invention is to extend the operational possibilities of a hydraulic system.

This object is solved in a hydraulic system mentioned above in that said working port arrangement comprises at least two working ports, flow direction changing means are provided changing a flow direction through said working port arrangement and inactivating means are provided inactivating or activating said booster section for each flow direction.

The booster section according to the invention may comprise at least one pressure booster and/or at least one flow booster. Such a hydraulic system can be used to operate a hydraulic consumer having two working directions. An example for such a hydraulic consumer is a hydraulic motor operating in two directions. This consumer can be supplied with the pressure supplied to the supply port alone, if this pressure is sufficient to operate the hydraulic consumer connected to the two working ports of the working port arrangement, or it can be operated using the booster section, e.g. the pressure intensifier, to supply an elevated pressure to the working port arrangement so that the consumer connected to the working port arrangement can be supplied with a higher pressure. This function is available for the two flow directions, i.e. when a motor is connected to the two working ports, it can be operated in both working directions with "normal" pressure or with intensified or amplified pressure. However, in such a system the pressure booster or pressure intensifier is activated only when required, i.e. the pressure booster is not "active" during normal operations. In this way, it is possible to select a lower pressure or a higher pressure simply by using the inactivating means. In other words, the system is able to supply "pressure on demand". Similarly, if the booster section comprises at least one flow booster, the flow boosters may only be activated when an increased amount of fluid flow is required.

In a preferred embodiment said booster section comprises a pressure booster for each flow direction. In this way each pressure booster can have its own inactivating means. Each pressure booster is related to a specific working port. Roughly spoken, such a system can be realized by two equal branches, each with its own pressure booster and its own working port.

In another preferred embodiment, said booster section comprises a common pressure booster for both flow directions. This is a cost saving embodiment.

Preferably said flow direction changing means comprise a control valve having two through flow conditions with different flow directions and a blocking condition. Such a control valve can be realized, for example, by a 4/3-way valve, i.e. a valve having a valve element which can be shifted to three different positions. In one position hydraulic fluid is supplied to one working port. In another position hydraulic fluid is supplied to the other working port. In a third position, both working ports are cut off from supply of hydraulic fluid. This control valve can be used to inactivate the whole hydraulic system.

Preferably a switch valve is arranged between said booster section and said working port arrangement. This switch valve is used to direct the hydraulic fluid pressurized by the booster section to the working port which should be supplied with high pressure hydraulic fluid.

In this case it is preferred that said switch valve is operated by the highest pressure in one of the lines to said working ports. No external control means are necessary to select the desired working port. The selection of the working port is made by the control valve.

Preferably a first flow path is provided outside said booster section and a second flow path is running through said booster section. The inactivating means define the way of the hydraulic fluid through the booster section. When the first flow path is chosen, there is no amplification of the pressure or the flow of the hydraulic fluid. Such an amplification takes place only when the second flow path is chosen.

Preferably said inactivating means are hydraulic means. They can be, for example, hydraulic valves.

Preferably said inactivating means comprise a sequence valve blocking a connection between said supply port and said pressure booster or connecting said supply port and said pressure booster. When said sequence valve is opened, said supply port is connected to an input of the pressure booster and consequently the pressure of the hydraulic fluid is amplified. The first flow path and the second flow path are combined at a port downstream said booster section. Since the pressure at this position is higher than the pressure in the first flow path, there is no flow of hydraulic fluid through the first flow path. A return of hydraulic fluid into a first flow path can be prevented by using a check valve.

Preferably said sequence valve is actuated by a pressure in said first flow path. The hydraulic system automatically adapts to the load conditions at the working port. When the hydraulic consumer connected to the working port is not able to work with the "normal" pressure supplied to the supply port, the pressure in the first flow path increases thereby actuating the sequence valve, which in turn automatically activates said booster section.

In a preferred embodiment said hydraulic system has a valve block comprising valves, and a booster block comprising said booster section. In this way it is rather simple to use different booster sections having, for example, different amplification ratios. One may also use different booster sections comprising pressure boosters and/or booster sections comprising flow boosters in the booster block.

In another preferred embodiment, said booster section comprises at least one flow booster. This way, one may also extend the operational possibilities of a hydraulic system. The at least one flow booster may be used alternatively or additionally to pressure boosters in the booster section. At least one flow booster may be a common flow booster for both flow directions.

In a preferred embodiment said booster section comprises a flow booster for each flow direction. In this way each flow booster can have its own inactivating means. Each flow booster can be related to a specific working port. Therefore, such a system can also be realized by two equal branches, each with its own flow booster and its own working port.

BRIEF DESCRIPTION OF THE DRAWINGS

Preferred embodiments of the invention will now be described in more detail with reference to the drawing, wherein.

DETAILED DESCRIPTION

Figure 1:
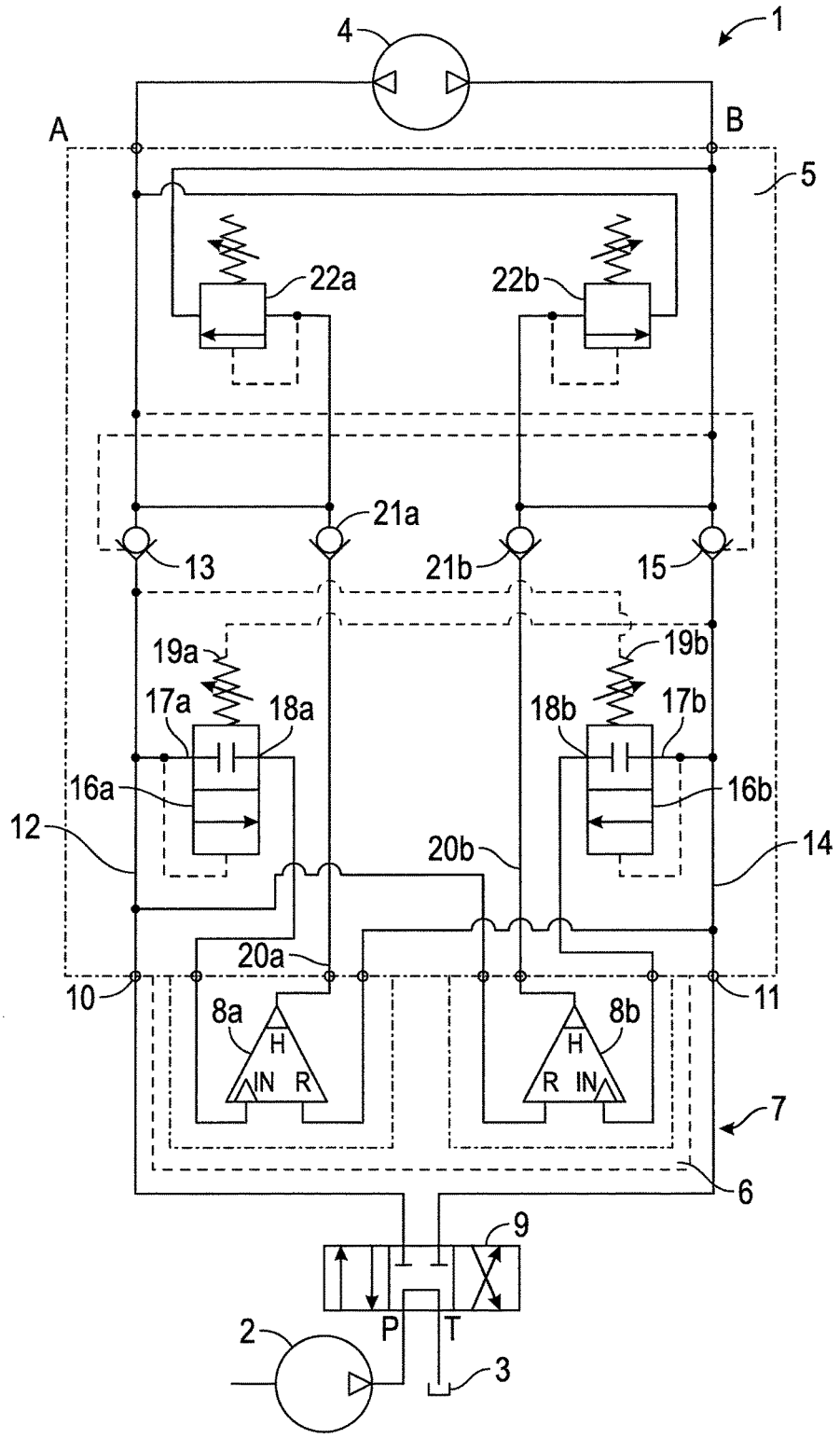
FIG. 1 shows a first embodiment of a hydraulic system.

A hydraulic system 1 according to FIG. 1 comprises a supply port arrangement having a supply port P and a return port T. The supply port P can be connected to a pressure source, for example a pump 2. The return port T can be connected to a tank 3.

The hydraulic system 1 further comprises a working port arrangement having two working ports A, B. The working ports A, B can be connected, as shown, to a hydraulic consumer. In the present embodiment, this consumer is a hydraulic motor 4 having two working directions.

The hydraulic system comprises a valve block 5 in which a number of valves are arranged which will be described in more detail below. Furthermore, the hydraulic system 1 comprises a booster block 6 comprising a booster section 7. The booster block 6 can be separated in two or more parts which can be individually fixed to the valve block 5.

In the embodiment of the hydraulic system 1 shown in FIG. 1, the booster section 7 comprises two pressure boosters 8*a*, 8*b*, said pressure boosters 8*a*, 8*b* being hydraulic pressure boosters or pressure intensifiers. Alternatively or additionally to the two pressure boosters 8*a*, 8*b* one may use flow boosters.

A control valve 9 is connected to the supply port arrangement P, T. In the present case, the control valve 9 is a 4/3-way valve having three possible switching conditions. In a first condition the control valve 9 connects the supply port P to a first connecting port 10 of the valve block 5. In this state, the control valve 9 connects a second connecting port 11 to the return port T.

In a second switching condition of the control valve 9 the supply port P is connected to the second connecting port 11 and the return port T is connected to the first connecting port 10. In a third switching condition of the control valve 9 a connection between the supply port arrangement P, T and the two connecting ports 10, 11 is interrupted.

The first connecting port 10 is connected to the first working port A via a line 12, said line 12 comprising a check valve 13 opening in a direction towards the working port A. The second connecting port 11 is connected to the second working port B via a line 14 comprising a check valve 15 as well opening in a direction towards the second working port B.

The two check valves 13, 15 both are piloted check valves. The check valve 13 can be opened by a pressure at the second working port B and the check valve 15 can be opened by a pressure at the first working port A. In this way it is possible to operate the motor 4 in both directions depending on the switching condition of the control valve 9. In a first working direction the motor 4 is supplied with hydraulic fluid flowing from the first working port A to the second working port B. In a second working direction the motor 4 is supplied with hydraulic fluid flowing from the second working port B to the first working port A.

The valve block 5 comprises a first sequence valve 16*a* and a second sequence valve 16*b*. An inlet 17*a* of the first sequence valve 16*a* is connected to the line 12. An outlet 18*a* of the first sequence valve 16*a* is connected to an input IN of the first pressure booster 8*a*. The sequence valve 16*a* is actuated by the pressure in the first line 12 in one direction and by the force of a spring 19*a* and a pressure in the second line 14 in the opposite direction. The force of the spring 19*a* is adjustable.

The spring 19*a* acts in a direction closing the sequence valve 16*a*, i.e. interrupting a connection between the input 17*a* and the output 18*a*. When this connection is interrupted, the first pressure booster 8*a* is not supplied with hydraulic fluid.

However, when the pressure in the first line 12 increases and overcomes the force of the spring 19*a*, the sequence valve 16*a* opens the connection between the input 17*a* and the output 18*a* so that hydraulic fluid having the pressure of the supply port P is supplied to the input IN of the first pressure booster 8*a*, increasing the pressure of the hydraulic fluid. The hydraulic fluid having this elevated pressure is supplied via a line 20*a* to the first working port A. A check valve 21*a* is arranged in line 20*a*. Therefore, when the pressure at the supply port P is not high enough to operate the motor 4 (or any other consumer connected to the working port arrangement A, B) the hydraulic pressure booster 8*a*, or pressure intensifier is automatically switched on via the sequence valve 16*a* and supplies hydraulic fluid under elevated pressure to the first working port A.

The same valving is provided for the other flow direction of the hydraulic fluid from the supply port P to the second working port B. An input 17*b* of the second sequence valve 16*b* is connected to the second line 14 interrupting or establishing a connection between this input 17*b* and an output 18*b* of the second sequence valve 16*b*. The output 18*b* of the second sequence valve 16*b* is connected to an input IN of the second pressure booster 8*b*, the output of which is connected to the second working port B via a second line 20*b*. This second line 20*b* as well comprises a check valve 21*b* opening in a direction to the working port B.

For both working connections a relief valve 22*a*, 22*b* is provided which will not be discussed in more detail.

The valve block 5 and the two parts of the booster block 6 are assembled together and can be assembled to the motor 4, for example, or to any other consumer. The consumer can be operated in two opposite directions, i.e. it is possible to establish a flow of hydraulic fluid from the first working port A to the second working port B and in the opposite direction from the second working port B to the first working port A. The pressure boosters 8*a*, 8*b* are used only when there is a corresponding pressure demand. In the embodiment shown in FIG. 1, the hydraulic system 1 uses completely equal "branches", each with its own pressure booster 8*a*, 8*b*.

Figure 2:
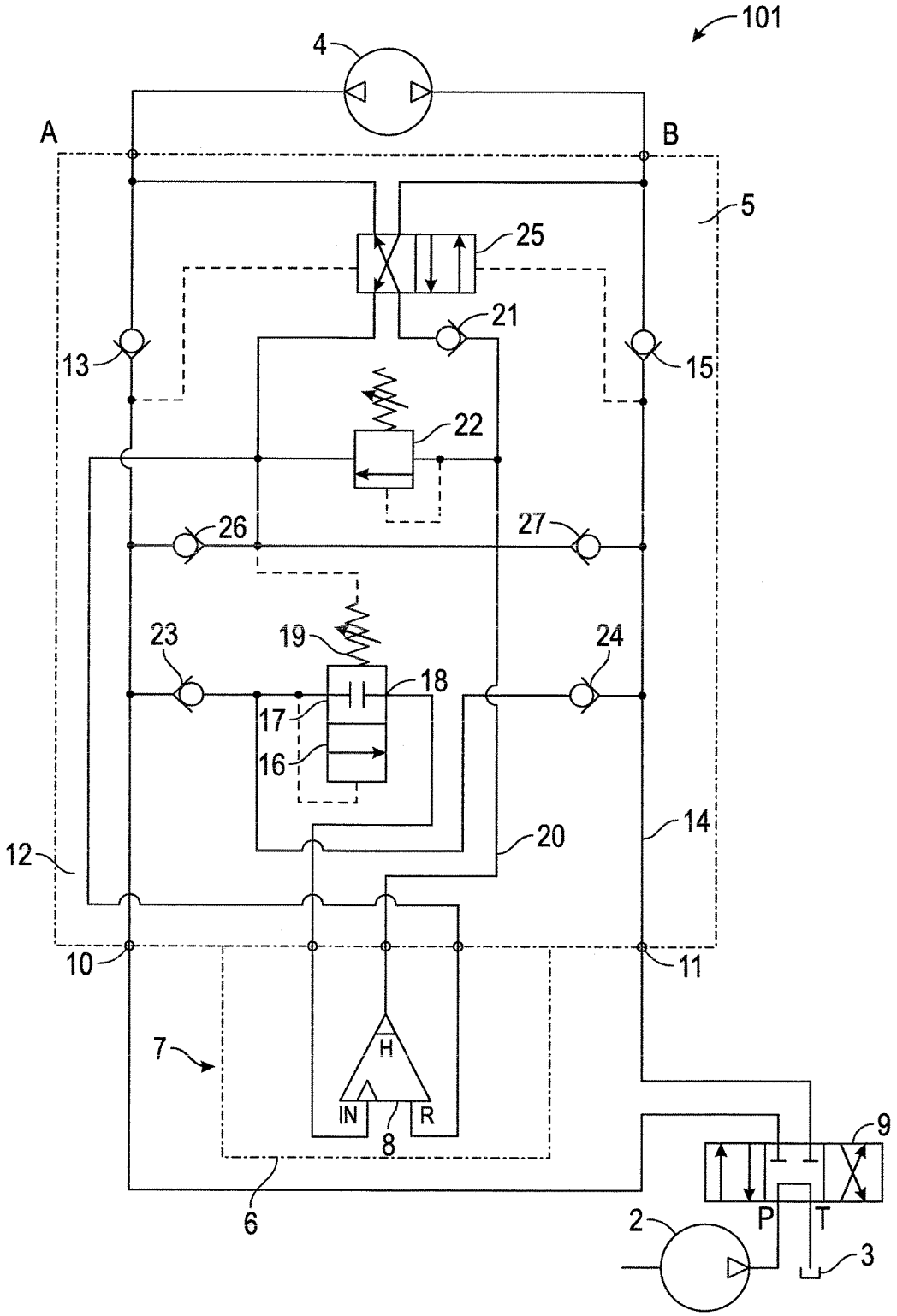
FIG. 2 shows a second embodiment of a the hydraulic system.

FIG. 2 shows another embodiment of a hydraulic system 101. Elements already shown in FIG. 1 are designated with the same reference numerals.

Again, this hydraulic system 101 comprises a valve block 5 having a number of valves which will be described later and a booster block 6 comprising a booster section 7. However, in this case the booster section 7 comprises a single pressure booster 8 only. Alternatively or additionally the booster section 7 may comprise a single flow booster.

Consequently, there is only a single sequence valve 16, the input 17 of which is connected to the first line 12 via a check valve 23 and to the second line 14 via a check valve 24. The two check valves 23, 24 prevent a short circuit between the two lines 12, 14. The two check valves 13, 15 in the lines 12, 14 do not need to be pilot operated check valves.

The output 18 of the sequence valve 16 is connected to the input IN of the pressure booster 8. The output H of the pressure booster 8 is connected, via the line 20 to a switch valve 25. In a first position, shown in FIG. 2, the switch valve 25 connects the output H of the pressure intensifier via line 20 to the first working port A. In a second switching position the switch valve 25 connects the output H via the line 20 with the second working port B. The respective other working port B, A is connected via check valves 26, 27 with the one of the lines 12, 14 which is connected via the control valve 9 with the return port T.

The switch valve 25 is operated by the pressures in the respective lines 12, 14 to the working ports A, B. When the pressure in the line 12 to the first working port A is higher than the pressure in the other line 14 to the second working port B the switch valve 25 is automatically switched in a condition in which the output H of the pressure booster 8 is connected to the first working port A. If the pressure in the second line 14 to the second working port B is higher than the pressure in the other line 12, the switch valve 25 is switched into another condition in which the output H of the pressure booster 8 is connected to the second working port B.

The operation of the system 101 is similar to that of the system 1 according to FIG. 1.

When the consumer connected to the working port arrangements A, B requires a pressure higher than the pressure at the supply port P, this pressure demand appears in the one of the lines 12, 14 connected to the supply port P via a control valve 9. This higher pressure acts on the sequence valve 16 hydraulically opening a connection between the input 17 and the output 18 of the sequence valve 16 and consequently establishing a connection between the supply port P and the input IN of the pressure booster 8. Consequently, the output H of the pressure booster 8 is connected via the line 20 and the switch valve 25 to the working port A requiring hydraulic fluid under elevated pressure.

If the flow direction is to be reversed, it is only necessary to actuate the control valve 9. When, for example, the supply port P is connected to the second connecting port 11, the second working port B is supplied with hydraulic fluid under the pressure at the pressure port P. When this pressure is not sufficient, the pressure in the line 14 is supplied to the input 17 of the sequence valve 16 opening the sequence valve 16 and supplying hydraulic fluid to the input IN of the pressure booster so that the pressure booster 8 can supply hydraulic fluid with elevated pressure to the second working port B via the line 20 and the switch valve 25.

A relief valve 22 is not discussed in further detail.

A check valve 21 can be arranged in the line 20 between the output H of the pressure booster 8 and the switch valve 25.

Figure 3:
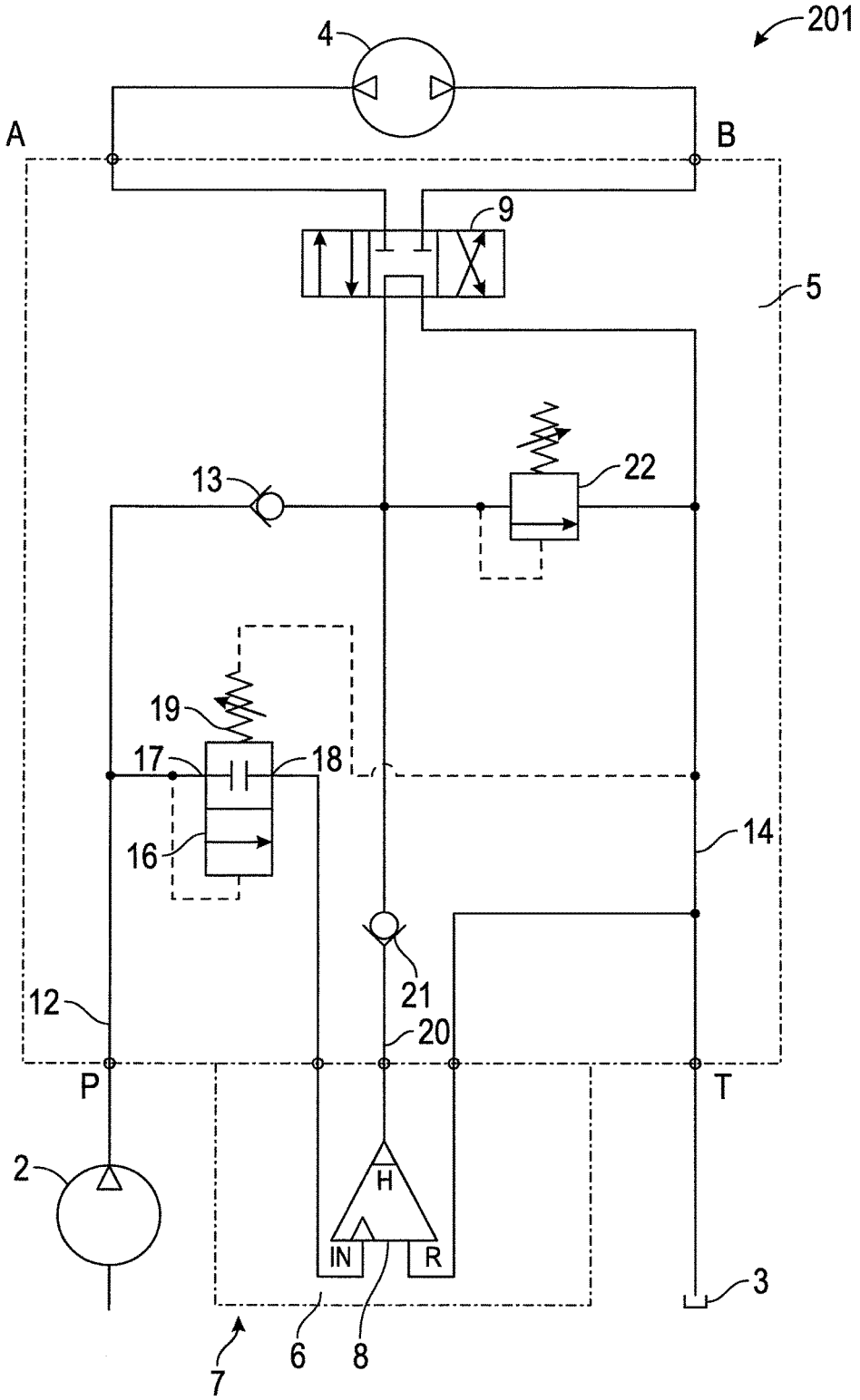
FIG. 3 shows a third embodiment of the hydraulic system.

FIG. 3 shows a third embodiment of a hydraulic system 201. The same elements are designated with the same numerals.

In this case the supply port arrangement P, T is arranged directly in the valve block 5. Furthermore, the control valve 9 is arranged in the valve block 5 as well. Depending on the switching condition of the control valve 9, the supply port P is connected to the first working port A or to the second working port B, where the other working port B, A is connected to the return port T. In a third switching condition, the two working ports A, B are separated from a supply of hydraulic fluid.

When the pressure at the supply port P is sufficient to operate the hydraulic motor 4 (or any other consumer connected to the working port arrangement A, B) the hydraulic pressure booster 8 is inactive since in this case the sequence valve 16 is closed and interrupts a connection between the input 17 and output 18 so that no hydraulic fluid is supplied to the inlet IN of the pressure booster 8.

However, when the pressure in the line 12 increases, for example, due to a corresponding requirement of the hydraulic consumer connected to the working port arrangement A, B, the sequence valve 16 is opened by the pressure at the supply port P overcoming the force of the spring 19 and the pressure at the return port T establishing a connection from the input 17 to the output 18 and supplying hydraulic fluid to the input IN of the pressure booster 8. In this case, hydraulic fluid having an elevated pressure is supplied from the output H of the pressure booster 8 via line 20 and the control valve 9 to the working port A, B requiring the elevated pressure. Hydraulic fluid returning from the hydraulic consumer flows through the other working port B, A and line 14 to the return connection T.

In all embodiments, there is, for each flow direction, a first flow path outside this pressure booster 8 and a second flow path running through said pressure booster 8. The choice of the flow path used is basically made by the sequence valve 16.

As illustrated, the pressure booster 8 or pressure intensifier is a hydraulic pressure booster. In a simple embodiment, such a hydraulic pressure booster 8 can be realized by using a differential piston having a larger face which is loaded by the pressure of the supply port P, and an opposite smaller face generating the higher pressure. The ratio between the two faces basically determines the amplification factor of the hydraulic pressure booster. In the embodiments illustrated the inactivating means are realized by the sequence valve 16 which is hydraulically operated. However, it is as well possible to use an electrically operated valve.

The pressure booster 8 can also have more than one amplification means which can be separately activatable. Such an embodiment is in particular useful, when a larger flow or a larger pressure is required. In the first case, a pressure booster 8 with several differential pistons can be used, for example 2, 4, 6, 8 or more pistons. These pistons can be activated at different intervals. When different pressures are required, it is possible to use differential pistons having different ratios between the two active surfaces. It is also possible to use a pressure booster 8 which is provided with means producing a variable booster pressure.

Preferably said pressure booster 8 has a maximum amplification factor of 20 or less, in particular in the range of 1.2 to 20, preferably 1.5 to 4. When for example the amplification factor is 1.8, the pressure booster 8 adds 80% of the pressure at the supply port P to the pressure of the supply port P so that the hydraulic consumer connected to the working port arrangement can be loaded with a pressure 1.8 times the pressure of the supply port P. Most hydraulic pressure systems are slightly over dimensioned, so that an "overpressure" does not adversely affect the hydraulic system. When this overpressure is supplied only for a short time, for example a few seconds, the hydraulic consumer can overcome a problematic working situation without time-consuming breaks in the working cycle and without exceeding the systems define-specifications.

The embodiments according to FIGS. 1 to 3 only show embodiments in which the booster section 7 comprises pressure boosters 8*a*, 8*b* or a common pressure booster 8. According to the invention one may alternatively or additionally use one or more flow boosters to extend the operational possibilities of the hydraulic system. In this case the flow boosters may be integrated into the hydraulic system in the same way as discussed for the pressure boosters 8*a*, 8*b*, 8 according to the embodiments of FIGS. 1 to 3 and the associated description.

While the present invention has been illustrated and described with respect to a particular embodiment thereof, it should be appreciated by those of ordinary skill in the art that various modifications to this invention may be made without departing from the spirit and scope of the present.

What is claimed is:

1. A hydraulic system comprising:

a supply port arrangement including at least a supply port;

a working port arrangement (A, B) comprising at least two working ports; and a booster section arranged between said supply port arrangement and said working port arrangement, the booster section comprising at least one pressure booster having at least one separately activatable amplification means;

flow direction changing means for changing a flow direction through said working port arrangement; and inactivating means for inactivating or activating said booster section for each flow direction.

2. The hydraulic system according to claim 1 wherein said booster section comprises a pressure booster for each flow direction.

3. The hydraulic system according to claim 2, wherein a first flow path is provided outside said booster section and a second flow path is running through said booster section.

4. The hydraulic system according to claim 3, wherein said inactivating means are hydraulic means.

5. The hydraulic system according to claim 4, wherein said inactivating means comprise a sequence valve blocking a connection between said supply port (P) and said pressure booster or connecting said supply port (P) and said pressure booster.

6. The hydraulic system according to claim 5, wherein said sequence valve is actuated by a pressure in said first flow path.

7. The hydraulic system according to claim 2, wherein said flow direction changing means comprise a control valve having two through flow conditions with different flow directions and a blocking condition.

8. The hydraulic system according to claim 2, wherein a valve block comprising valves, and a booster block comprising said booster section.

9. The hydraulic system according to claim 1, wherein said booster section comprises a common pressure booster for both flow directions.

10. The hydraulic system according to claim 9, wherein said flow direction changing means comprise a control valve having two through flow conditions with different flow directions and a blocking condition.

11. The hydraulic system according to claim 9, wherein a first flow path is provided outside said booster section and a second flow path is running through said booster section.

12. The hydraulic system according to claim 1, wherein said flow direction changing means comprise a control valve having two through flow conditions with different flow directions and a blocking condition.

13. The hydraulic system according to claim 12, wherein a switch valve is arranged between said booster section and said working port arrangement (A, B).

14. The hydraulic system according to claim 13, wherein said switch valve is operated by the highest pressure in one of the lines to said working ports (A, B).

15. The hydraulic system according to claim 14, wherein a first flow path is provided outside said booster section and a second flow path is running through said booster section.

16. The hydraulic system according to claim 13, wherein a first flow path is provided outside said booster section and a second flow path is running through said booster section.

17. The hydraulic system according to claim 12, wherein a first flow path is provided outside said booster section and a second flow path is running through said booster section.

18. The hydraulic system according to claim 1, wherein a valve block comprising valves, and a booster block comprising said booster section.

19. The hydraulic system according to claim 1, wherein said booster section comprises at least one flow booster.

20. The hydraulic system according to claim 19, wherein said booster section comprises a flow booster for each flow direction.

* * * * *